US006447287B1

(12) United States Patent
Hsu

(10) Patent No.: US 6,447,287 B1
(45) Date of Patent: Sep. 10, 2002

(54) SAFETY GAS LIGHTER

(76) Inventor: Huang-Hsi Hsu, 8F, No. 14, Lane 252, Chungshan N. Rd., Sec. 6, Taipei (TW)

( * ) Notice: Subject to any disclaimer, the term of this patent is extended or adjusted under 35 U.S.C. 154(b) by 8 days.

(21) Appl. No.: 09/689,668

(22) Filed: Oct. 13, 2000

(51) Int. Cl.[7] ..... F23D 11/36; F23Q 7/12

(52) U.S. Cl. ..... 431/153; 431/255; 431/256; 431/344; 126/401; 126/405

(58) Field of Search ..... 431/255, 153, 431/256, 344, 142; 126/401, 405, 414, 415, 229

(56) References Cited

U.S. PATENT DOCUMENTS 5,975,888 A * 11/1999 Hsu ..... 431/255
5,980,242 A * 11/1999 Man ..... 431/344
5,997,282 A * 12/1999 Man ..... 431/153
6,059,563 A * 5/2000 Hsu ..... 431/153

* cited by examiner

*Primary Examiner*—Henry Bennett
*Assistant Examiner*—Kathryn Ferko
(74) *Attorney, Agent, or Firm*—Bacon & Thomas

(57) ABSTRACT

A gas lighter includes a handgrip holding a fuel tank and an electric arc generator, an actuating device pivoted to the inside of the handgrip, an ignition button mounted in an opening on the handgrip and adapted to trigger the electric arc generator in producing an electric arc for burning fuel gas discharged out of a gas nozzle in a cylindrical metal casing at one end of the handgrip and simultaneously to drive the actuating device in opening the fuel tank for enabling fuel gas to flow out of the fuel tank to the gas nozzle for burning, and a spring-supported locking lever assembly mounted in a sector slot on the handgrip and adapted to move the actuating device between the operative position and the non-operative position.

6 Claims, 8 Drawing Sheets

SAFETY GAS LIGHTER

BACKGROUND OF THE INVENTION

The present invention relates to gas lighters, and more particularly to a gas lighter with dual safety mechanisms, which comprises a stop mechanism controlled by a lever to stop the ignition button of the gas lighter froml triggering the electric arc generator of the gas lighter and moving the gas lever of the fuel tank when opening the fuel gas outlet.

FIG. 1 illustrates a gas lighter according to the prior art. This structure of gas lighter 1 comprises a substantially rectangular handgrip 10 with a tube 12 at its one end, a fuel tank 14 and an electric arc generator 16 mounted inside the handgrip 10. The fuel tank 14 has a gas outlet 142 connected to a gas nozzle in the tube 12 (not shown) by a gas hose 144, and a gas lever 146 adapted to close/open the gas outlet 142. The handgrip 10 has an opening 18. An ignition button 19 is suspended in the handgrip 10 and partially projects out of the opening 18. The bottom side of the ignition button 19 faces the actuator 162 of the electric arc generator 16. The electric arc generator 162 has a first electrode connected to the 20 gas nozzle. and a second electrode (not shown) connected to the tube 12. As illustrated in FIG. 2, a stop mechanism 2 is provided between the ignition button 19 and the fuel tank 14 inside the handgrip 10. The stop mechanism 2 comprises a base frame 20 pivoted to the handgrip 10, a lever 22 inserted through a hole on the handgrip 10 and connected to the base frame 20, a first spring element 202 adapted to return the base frame 20 after the lever 22 has been pressed and then released, a link 24 slidably coupled to the base frame 20 and aimed at the ignition button 19, and a second spring element 242 adapted to return the link 24 after the link 24 has been pressed and then released. When turning the lever 22 of the stop mechanism 2 to move the link 24 to the fuel tank 14 and then pressing the ignition button 19, the link 24 is forced downwards against the gas lever 146, causing the fuel tank 14 to release fuel gas through the gas hose 144 to the gas nozzle, and at the same time the actuator 162 of the electric arc generator 16 is triggered to generate an electric arc around the gas nozzle, and therefore a flame is produced at the gas nozzle. If the lever 22 of the stop mechanism 2 is not turned to the unlocking position before pressing the ignition button 19, the down stroke of the ignition button 19 can only trigger the electric arc generator 16 to generate an electric arc without opening the gas outlet 142 of the fuel tank 14. However, this design is still not satisfactory in function. Because the actuator 162 of the electric arc generator 16 will be triggered when pressing the ignition button 19 without turning the lever 22 of the stop mechanism 2 to the unlocking position the gas lighter 1 is still not safe in use. When a child plays with the gas lighter and presses the ignition button 19 by accident, a flame will be produced, and the flame may injure the child.

SUMMARY OF THE INVENTION

The invention has been accomplished to provide a safety gas lighter, which eliminates the aforesaid problem. According to one aspect of the present invention, the safety gas lighter comprises a spring supported actuating device, which is caused to drive a gas lever to open a fuel tank gas outlet and enable fuel gas to flow out of the fuel tank to a gas nozzle for burning when the user presses an ignition button to trigger an electric arc generator, and to produce an electric arc around the gas nozzle, and a locking lever assembly adapted to turn the actuating device between the operative position and the non-operative position. According to another aspect of the present invention, the locking lever assembly comprises a spring supported sliding member that can be engaged into a positioning hole in the handgrip of the safety gas lighter to lock the actuating device in the non-operative position. When locked, pressing the ignition button does not open the fuel tank to discharge fuel gas.

DETAILED DESCRIPTION OF THE PREFERRED EMBODIMENT

Figure 1:
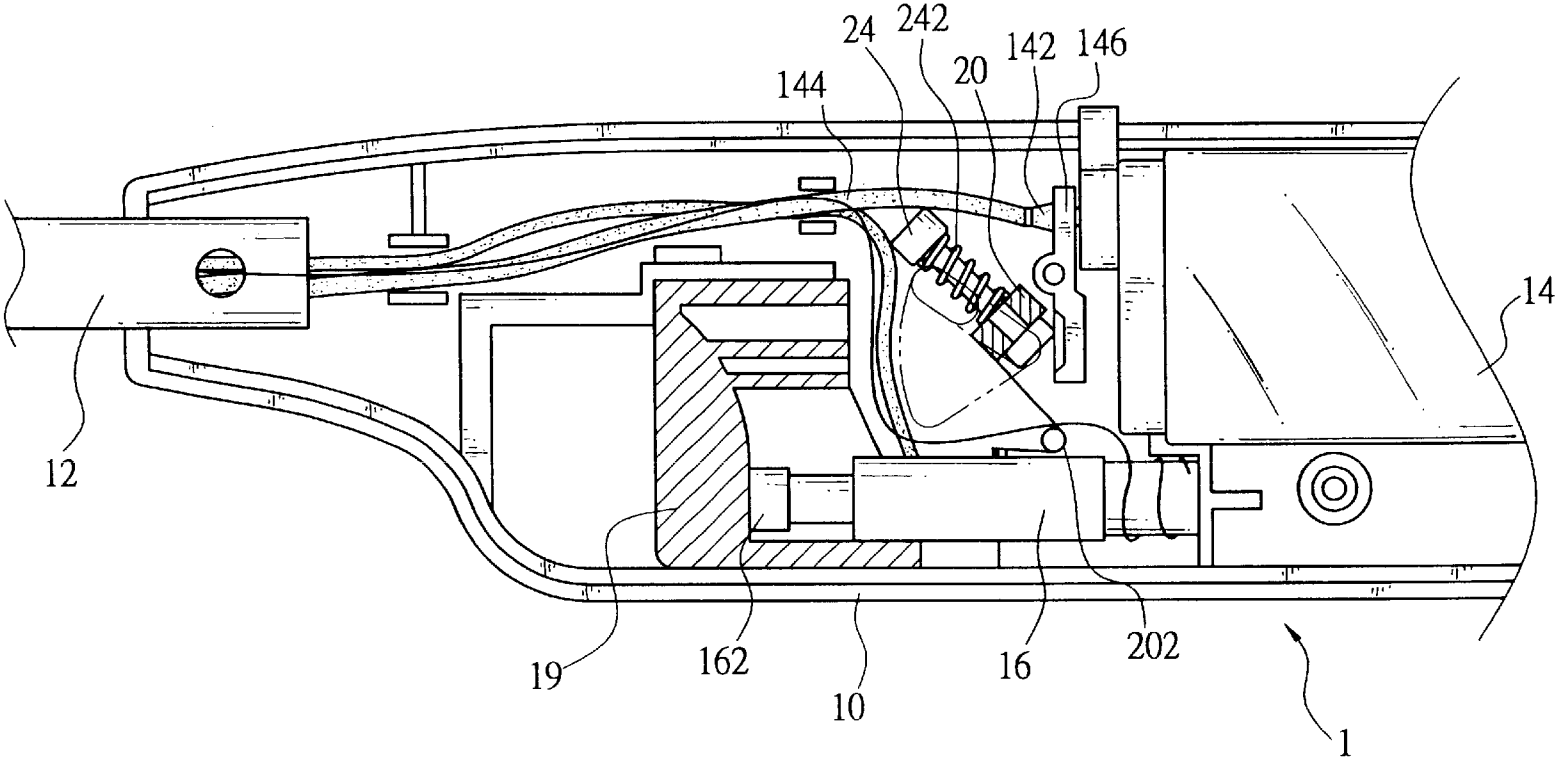
PRIOR ART FIG.1
FIG. 1 is a plain view of a gas lighter according to the prior art.
Figure 2:
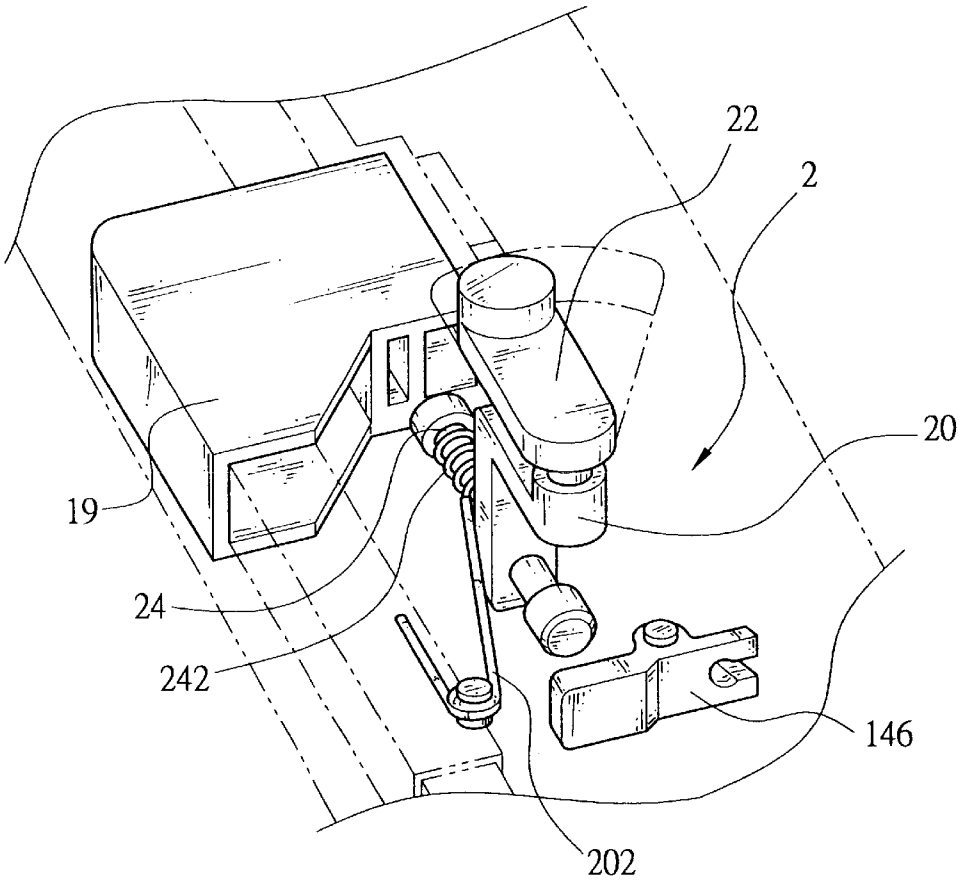
PRIOR ART FIG.2
FIG. 2 is a perspective view in an enlarged scale of a part of FIG. 1.
Figure 3:
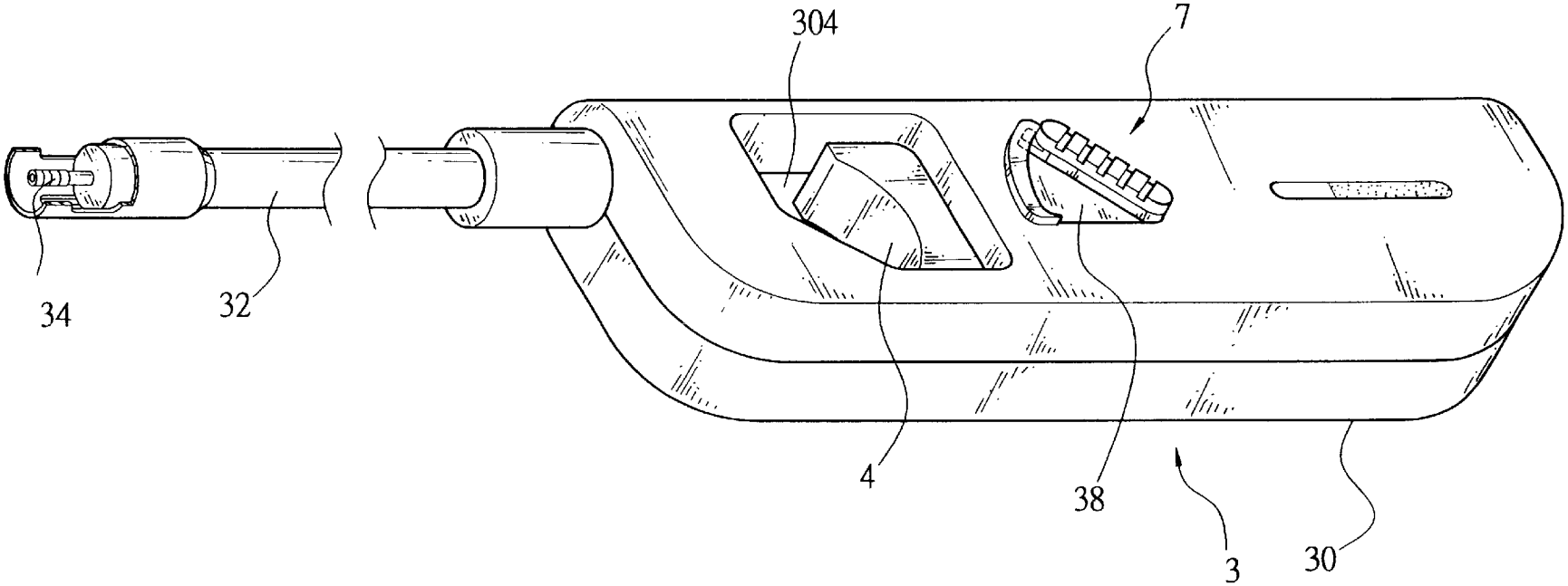
FIG. 3 is an elevational view of a safety gas lighter according to a first embodiment of the present invention.
Figure 4:
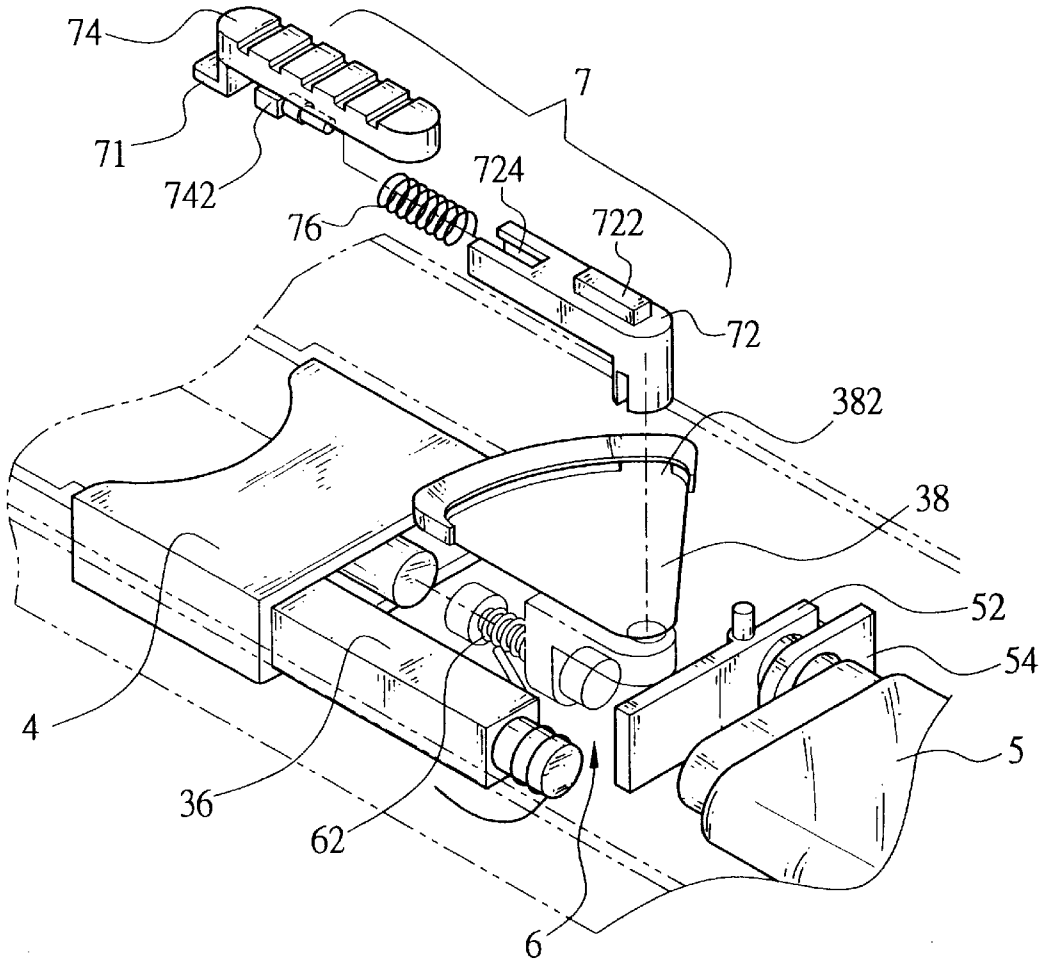
FIG. 4 is an exploded view in an enlarged scale of the safety gas lighter, shown in FIG. 3.

Referring to FIGS. 3 and 4, a safety gas lighter 3 comprises a handgrip 30, a cylindrical metal casing 32 longitudinally extended from one end, namely, the front end of the handgrip 30, and a metal gas nozzle 34 suspended in the cylindrical metal casing 32 near the front end of the cylindrical metal casing 32 remote from the handgrip 30. Inside the handgrip 30, there are provided a fuel tank 5, an electric arc generator 36, and an actuating device 6. The handgrip 30 has a sector slot 38 through the top side wall thereof. A lever assembly 7 is inserted through the sector slot 38 and coupled to the actuating device 6, and can be moved in and out of a positioning hole 382 inside the sector slot 38. An ignition button 4 is mounted in the handgrip 30 and disposed in contact with the electric arc generator 36. When disengaging the locking lever assembly 7 from the positioning hole 382, the locking lever assembly 7 can be turned in the sector slot 38 to move the actuating device 6 to the operative position where a spring supported link 62 of the actuating device 6 is aligned between the gas lever 52 of the fuel tank 5 and the ignition button 4. When pressing the ignition button 4 at this time, the ignition button 4 triggers the electric arc generator 36 and simultaneously forces the link 62 to move the gas lever 52 to open the valve (not shown) in the fuel gas outlet of the fuel tank 5, thereby causing fuel gas to flow out of the fuel tank 5 to the gas nozzle 34 through a gas tube (not shown), and causing the electric arc generator 36 to discharge an electric arc around the gas nozzle 34. As a result, fuel gas is burned at the fuel gas outlet of the gas nozzle 34. Further, a flame adjustment knob 54 is coupled to the valve in the fuel gas outlet of the fuel tank 5, and partially extended out of the handgrip 30 for turning by hand to adjust the flow rate of fuel gas to the gas nozzle 34, so as to adjust the intensity of the flame.

Referring to FIGS. 3 and 4 again, the handgrip 30 has an opening 304 through the top and bottom side walls thereof. The ignition button 4 has a part projecting into the opening 304. The user can insert one finger into the opening 304 to operate the ignition button 4. The electric arc generator 36 is mounted inside the handgrip 30 adjacent to the fuel tank 5, and has positive and negative electrodes respectively connected to the gas nozzle 34 and the cylindrical metal casing 32. When pressing the ignition button 104 to trigger the electric arc generator 36, an electric arc is produced between the gas nozzle 34 and the cylindrical casing 32. When released, the ignition button 4 is pushed back to its former position by the reactive force of the spring element (not shown) in the electric arc generator 36.

Figure 5:
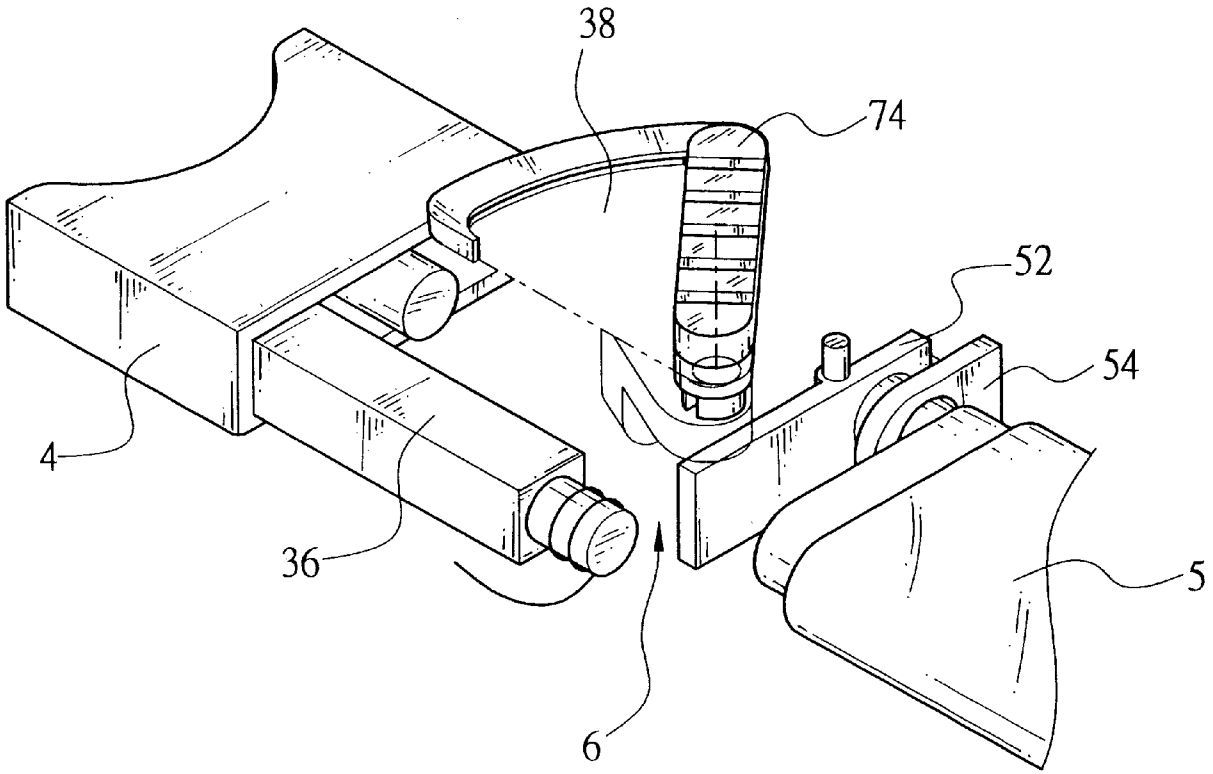
FIG. 5 is a perspective view in an enlarged scale of a part of the first embodiment of the present invention, showing the actuating device moved with the locking lever assembly to the non-operative position.
Figure 6:
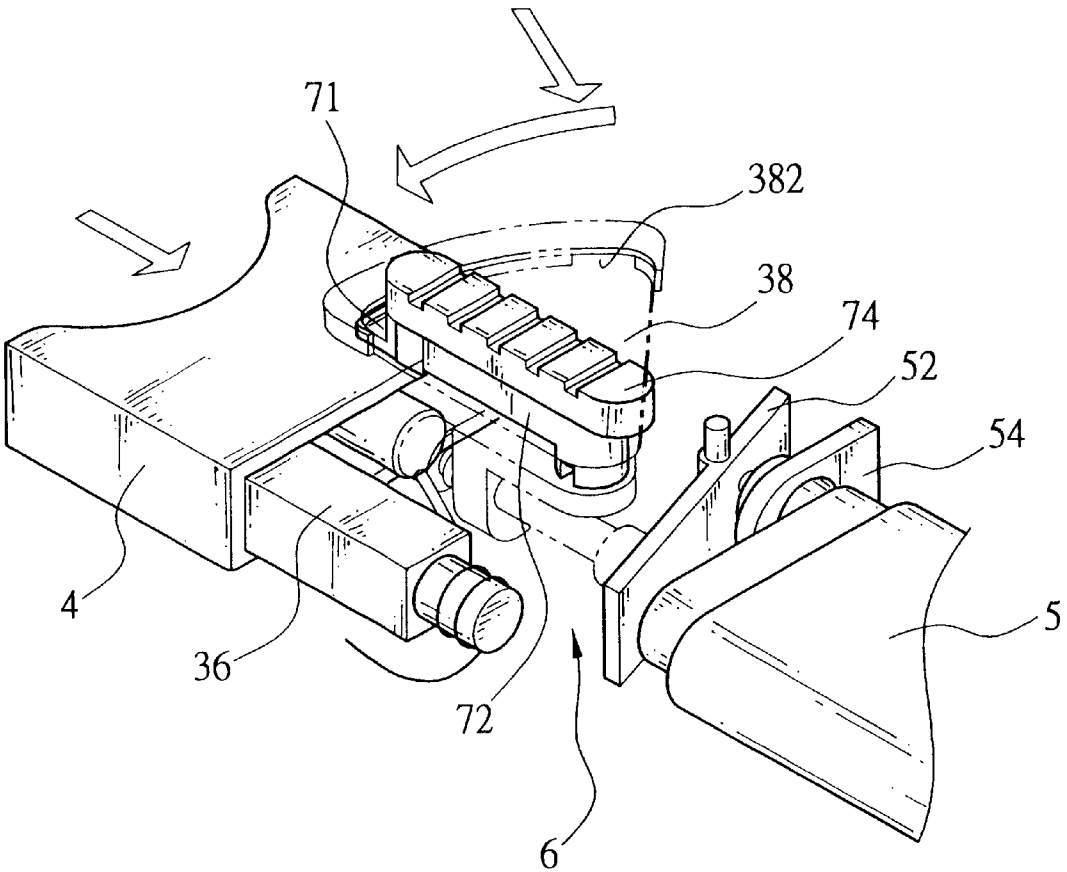
FIG. 6 is a perspective view in an enlarged scale of a part of the first embodiment of the present invention, showing the device moved with the locking lever assembly to the operative position.

Referring to FIGS. 5 and 6 and FIGS. 3 and 4 again, the locking lever assembly 7 comprises an angled swivel base 72, and a sliding member 74. The angled swivel base 72 is adapted to support the sliding, member 74, having an angled rear-end pivoted with the actuating device 6 to the inside of the handgrip 30. The sliding member 74 is supported on a spring 76 at the swivel base 72, and can be moved back and forth on the swivel base 72. The swivel base 72 comprises a guide block 722 and a sliding slot 724 in front of the guide block 722. The sliding member 74 comprises a bottom sliding groove (not shown) coupled to the guide block 722 of the swivel base 72, a bottom guide rod 742 supported on the spring [75] 76 and inserted into the sliding slot 724 of the swivel base 72, and a front positioning strip 71 adapted for engaging into, i.e., entering and engaging, the positioning hole 382 in the sector slot 38 of the handgrip 30. When moving the sliding member 74 backwards on the swivel base 72 to compress the spring 76, the front positioning strip 71 of the sliding member 74 is disengaged from the positioning hole 382 of the handgrip 30, and can be turned in the sector slot 38 to move the actuating device 6 between the operative position and the non-operative position. When moving the actuating device 6 to the operative position, the spring-supported link 62 is disposed in alignment between the ignition button 4 and the gas lever 52. At this time, the user can press the ignition button 4 to trigger the electric arc generator 36, and to move the gas lever 52 in opening the fuel gas outlet of the fuel tank 5. When releasing the ignition button 4, the spring supported link 62 is pushed back to its former position by the spring force of the spring means mounted on it; and then the sliding member 74 is forced by the spring 76 to move the front positioning strip 71 into the positioning hole 382 again, and therefore the actuating device 6 are locked in the non-operative position.

Figure 7:
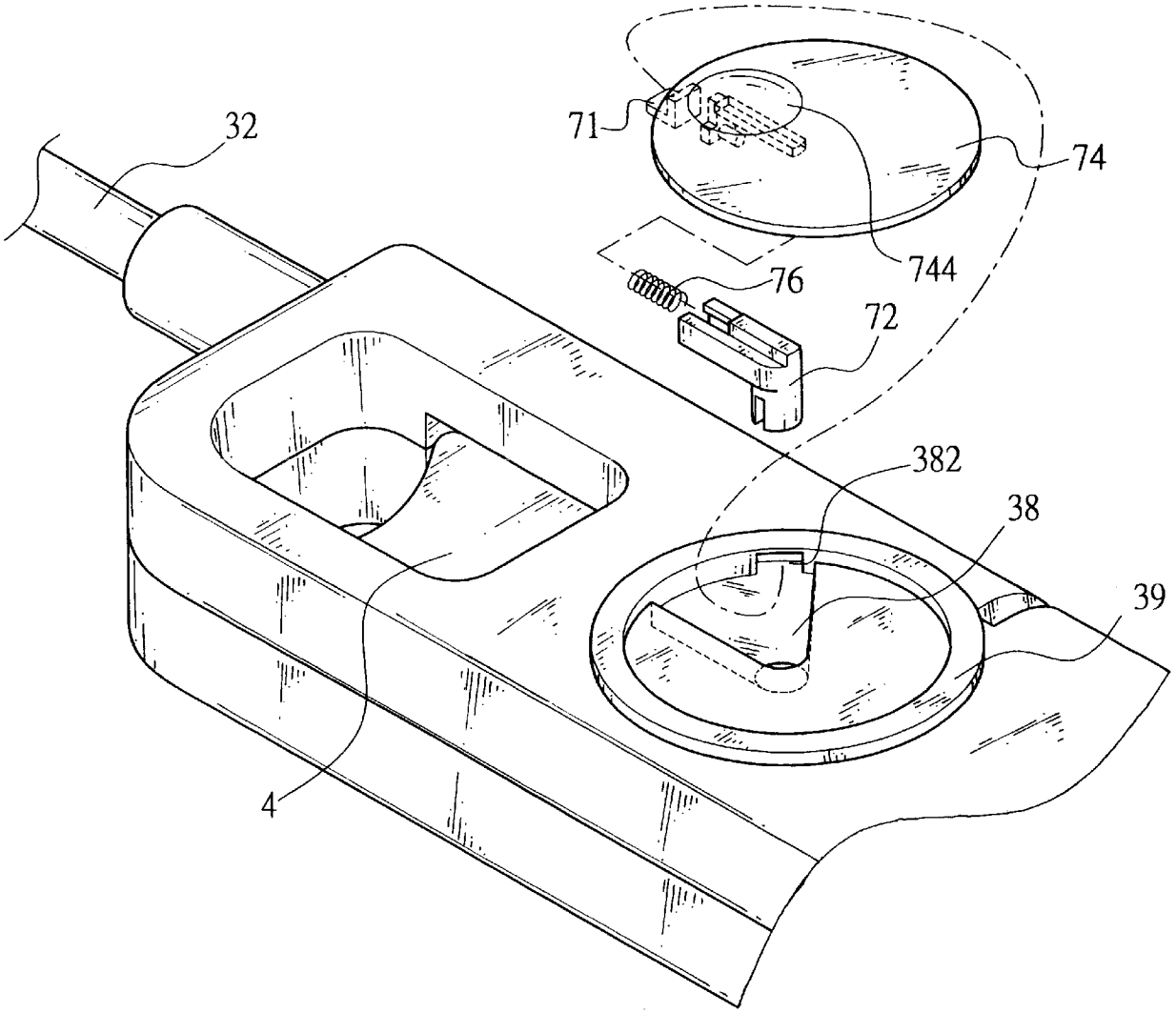
FIG. 7 is an exploded view of a part of a safety gas lighter according to a second embodiment of the present invention.
Figure 8:
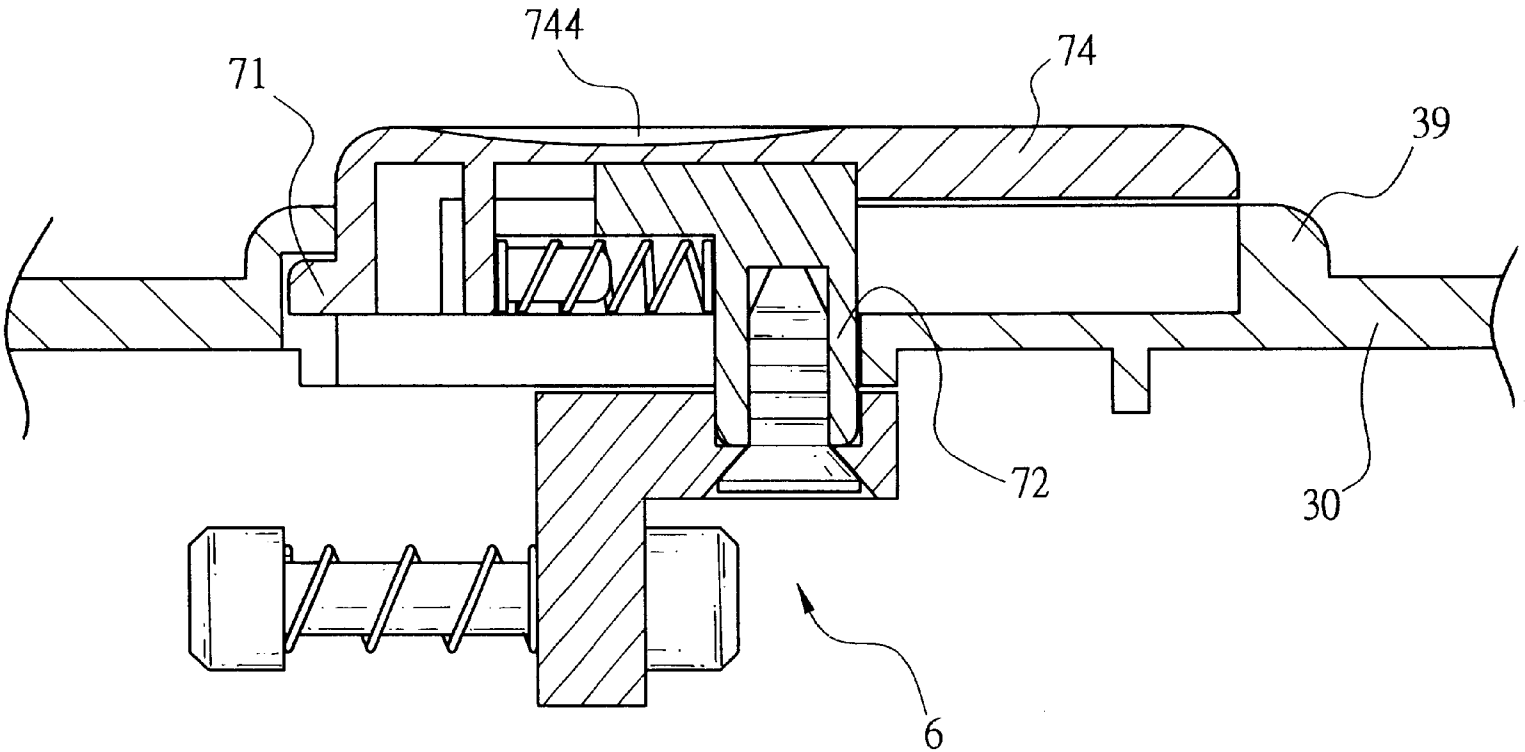
FIG. 8 is a sectional assembly view in an enlarged scale of a part of the second embodiment of the present invention.

FIGS. 7 and 8 show an alternate form of the present invention. According to this alternate form, a circular flange 39 is formed integral with the top side wall of the handgrip 30 around the sector slot 38, and the sliding member 74 is supported on the swivel base 72 and partially covered on the circular flange 39. The sliding member 74 has a finger recess 744 at the top surface thereof for the positioning of one finger positively. By means of pressing one finger on the finger recess 744, the sliding member 74 can positively be moved along the swivel base 72 and turned to move the actuating device 6 to the operative position. When a child plays with the safety gas lighter, the child cannot easily find out the function of the locking lever assembly 7. It is to be understood that the drawings are designed for purposes of illustration only, and are not intended for use as a definition of the limits and scope of the invention disclosed. For example, the fuel tank can be made having a fuel gas filling hole at the bottom side, and the handgrip can be made having a bottom hole aimed at the fuel gas filling hole of the fuel tank.

What the invention claimed is:

1. A safety gas lighter comprising:

a handgrip, said handgrip comprising a cylindrical metal casing extending from one end thereof, a sector slot on a top side wall thereof, an opening through top and bottom side walls thereof, and a positioning hole in a side sector slot;

a metal gas nozzle suspended in one end of said cylindrical metal casing remote from said handgrip;

a fuel tank mounted in said handgrip remote from said cylindrical metal casing and holding a fuel gas, said fuel tank comprising a fuel gas valve, a gas hose connected between said fuel has valve and said metal gas nozzle, and a gas lever coupled to said fuel gas valve and adapted to open said fuel gas valve for enabling said fuel gas to flow out of said fuel tank to said gas nozzle for burning;

an electric arc generator mounted inside said handgrip adjacent to said fuel tank, said electric arc generator comprising a first electrode connected to said gas nozzle, and a second electrode connected to said cylindrical metal casing;

a spring-supported actuating device mounted inside said handgrip and adapted for driving said gas lever to open said fuel gas valve of said fuel tank;

an ignition button mounted in the opening of said handgrip and adapted for pressing by hand to trigger said electric arc generator in producing an electric arc between said gas nozzle and said cylindrical metal casing and to drive said spring-supported actuating device to move said gas lever in opening said fuel gas valve of said fuel tank; and a locking lever assembly mounted in said sector slot of said handgrip and turned to move said spring-supported actuating device between a first position where said locking lever assembly is engaged into the positioning hole of said handgrip and said spring-supported actuating device is moved out of the path of said ignition button, preventing said ignition button from driving said gas lever, and a second position where said spring-supported actuating device is moved into alignment between said ignition button and said gas lever for driving by said ignition button to move said gas lever in opening said fuel gas valve of said fuel tank, wherein said locking lever assembly comprises a swivel base pivoted with said spring-supported actuating device to a part of said handgrip, a sliding member coupled to said swivel base and adapted to be moved on said swivel base, said sliding member comprising a front positioning strip adapted for engaging into the positioning hole of said handgrip, and spring means coupled between said swivel base and said sliding member and adapted to force said front positioning strip of said sliding member into the positioning hole of said handgrip.

2. The safety gas lighter of claim 1 wherein said swivel base comprises a guide block and a sliding slot adapted to guide movement of said sliding member on said swivel base, and said sliding member comprises a bottom sliding groove coupled to the guide block of said swivel base and a bottom guide rod inserted into the sliding slot of said swivel base.

3. The safety gas lighter of claim 1 wherein said handgrip comprises a circular flange formed integral with the top side wall thereof around said sector slot, and said sliding member is slidably supported on said swivel based and covered over said circular flange.

4. The safety gas lighter of claim 3 wherein said sliding member has a top recess for the positioning of a finger.

5. The safety gas lighter of claim 1 further comprising flame adjustment knob coupled to said fuel gas valve of said fuel tank and partially extended out of said handgrip and adapted for adjusting the flow rate of the fuel gas passing out of said fuel gas valve to said gas nozzle.

6. The safety gas lighter of claim 1 wherein said fuel tank has a fuel gas filling hole at a bottom side thereof, and said handgrip has a bottom hole aimed at said fuel gas filling hole.

* * * * *